US010993584B1

(12) United States Patent
Highland et al.

(10) Patent No.: US 10,993,584 B1
(45) Date of Patent: May 4, 2021

(54) BATHING AREA SURROUND

(71) Applicant: Royal Baths Manufacturing Company, Houston, TX (US)

(72) Inventors: Keith Highland, Fort Worth, TX (US); Jon Coverick, Plano, TX (US)

(73) Assignee: Royal Baths Manufacturing Company, Houston, TX (US)

( * ) Notice: Subject to any disclaimer, the term of this patent is extended or adjusted under 35 U.S.C. 154(b) by 0 days.

(21) Appl. No.: 16/870,690

(22) Filed: May 8, 2020

(51) Int. Cl.
*A47K 3/08* (2006.01)

(52) U.S. Cl.
CPC ..... *A47K 3/08* (2013.01)

(58) Field of Classification Search
None
See application file for complete search history.

(56) References Cited

U.S. PATENT DOCUMENTS 3,605,352 A 9/1971 Ruggles et al.
4,384,377 A 5/1983 Calvert et al.
4,553,276 A * 11/1985 Paradis ..... A47K 3/284 4/596
6,425,147 B1 7/2002 Hanson
6,691,339 B1 2/2004 Thomas
6,938,764 B2 9/2005 Edwards et al.
7,634,823 B2 * 12/2009 Sisk ..... A47K 3/30 4/614
8,082,608 B2 12/2011 Dabrowski
8,332,972 B2 12/2012 Bullis et al.
8,918,927 B1 * 12/2014 Smith ..... A47K 3/284 4/619
9,027,176 B2 5/2015 Dabrowski
9,642,500 B2 5/2017 Groner et al.

FOREIGN PATENT DOCUMENTS

WO WO2013/021031 8/2012

* cited by examiner

*Primary Examiner* — Janie M Loeppke
(74) *Attorney, Agent, or Firm* — Eric Karich; Karich & Associates

(57) ABSTRACT

A bathing area surround includes a bathtub and a tub surround. The bathtub has a bathing basin that extends upwardly to a tub ledge extending outwardly from a rim, traverse to a sidewall, to an edge having tub flange is shaped to form at least one inwardly extending pocket that forms a tab receiving recess. The tub surround includes a back panel, and two side panels. The back panel and the two side panels each have downwardly extending locking tabs formed in their bottom edges, shaped to be inserted into the corresponding tab receiving recess, behind the tub flange. The back panel is then fastened to each of the two side panels via fasteners.

7 Claims, 3 Drawing Sheets

BATHING AREA SURROUND

BACKGROUND OF THE INVENTION

Field of the Invention

This invention relates generally to bathtubs, and more particularly to a combination bathtub and surround that include an interlocking tab and flange system for interlocking the bathtub and surround in a manner that facilitates installation and prevents leaks.

Description of Related Art

The prior art teaches a variety of bathtubs and surrounds which interlock in various manners:

Dabrowski, U.S. Pat. No. 8,082,608, teaches a bathing area that includes a bathtub and surround wall. The bathtub has a tub side that extends upwardly to a ledge extending transverse to the tub side. The surround wall includes a tongue (42) that fits within groove (46) in the tub ledge (30), but the groove is positioned inside of a tub flange (50), rather than behind the flange (as is the case in the present invention. The configuration of the groove being positioned behind the flange, in the present invention, prevents leaks.

Ruggles, U.S. Pat. No. 3,605,352, teaches a bathtub and surround with a similar construction.

Bullis, U.S. Pat. No. 8,332,972, teaches a bath tub surround enclosure which includes enclosure walls. The tub/receptor has an upper rim on which rests a rear wall. A side wall is pivotably connected at its upper rear to an upper front side of the rear wall and then pivots downwardly to create a horizontal watertight seal between the side and rear walls. Simultaneously, a lower retaining finger at the front bottom of the side wall catches between an insert on the upper rim and the upper rim.

Dabrowski, U.S. Pat. No. 9,027,176, teaches a bath tub surround that includes a rear and side panels having a slot flange and a hook flange. A hook-like projection on the hook flange of a first panel is extendable into a slot on the slot flange of a second panel. Another example bathing area surround includes the slot flange on a first bathing panel and the hook flange on a second bathing panel, and a seal located on at least one of the slot flange or the hook flange.

The prior art does not teach a surround wherein the tongue is positioned into a receiver that is positioned behind the flange, and does not extend downwardly into the tub ledge. The present invention fulfills these needs and provides further advantages as described in the following summary.

SUMMARY OF THE INVENTION

The present invention teaches certain benefits in construction and use which give rise to the objectives described below.

The present invention provides a bathing area surround comprising a bathtub and a tub surround, the tub surround comprising a back panel, and two side panels, each of the back panel and the two side panels having a bottom edge and two side edges. The bathtub has a bathing basin formed by a bottom surface surrounded by an upwardly extending sidewall which extends upwardly to a rim, the bathtub further comprising a tub ledge extending outwardly from the rim, traverse to the sidewall, to an edge. The tub ledge is formed by a front portion and a rear portion connected by side portions, and a tub flange which extends upwardly from the rear portion and the side portions of the tub ledge adjacent the edge. The tub flange is shaped to form at least one inwardly extending pocket in the rear portion, and each of the side portions, which forms a tab receiving recess. The back panel and the two side panels each have downwardly extending locking tabs formed in their bottom edges, shaped to be inserted into the corresponding tab receiving recess, behind the tub flange. The back panel is then fastened to each of the two side panels via fasteners.

A primary objective of the present invention is to provide a bathing area surround having advantages not taught by the prior art.

Another objective is to provide a bathing area surround having a downwardly extending locking tab positioned behind a flange, without extending downwardly into the tub ledge.

A further objective is to provide a bathing area surround having a water-tight seam secured by fasteners.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a bathing area surround that is fast and easy to install, and which does not leak.

Figure 1:
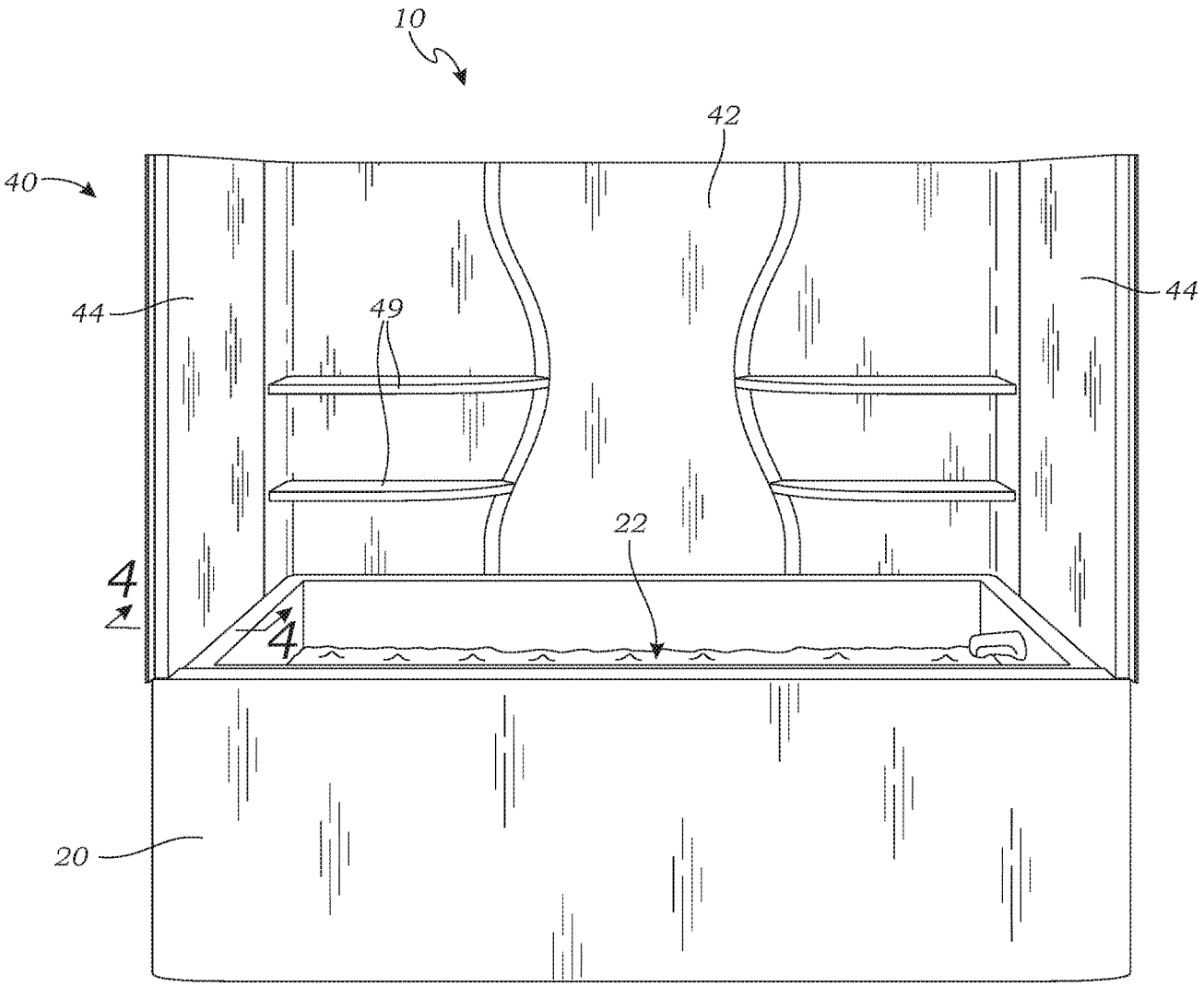
FIG. 1 is a front elevational view of a bathing area surround according to one embodiment of the present invention.

FIG. 1 is a front elevational view of a bathing area surround 10 according to one embodiment of the present invention, shown in a fully assembled configuration. As shown in FIG. 1, the bathing area surround 10 comprises a bathtub 20 and a tub surround 40. The tub surround 40 includes a back panel 42 and two side panels 44 which together surround three sides of the bathtub 20. The bathing area surround 10 may further include many different features and designs, such as shelves 49, and may further include any ornamentation, texture, or any other features commonly associated with shower or bathtub walls.

Figure 2:
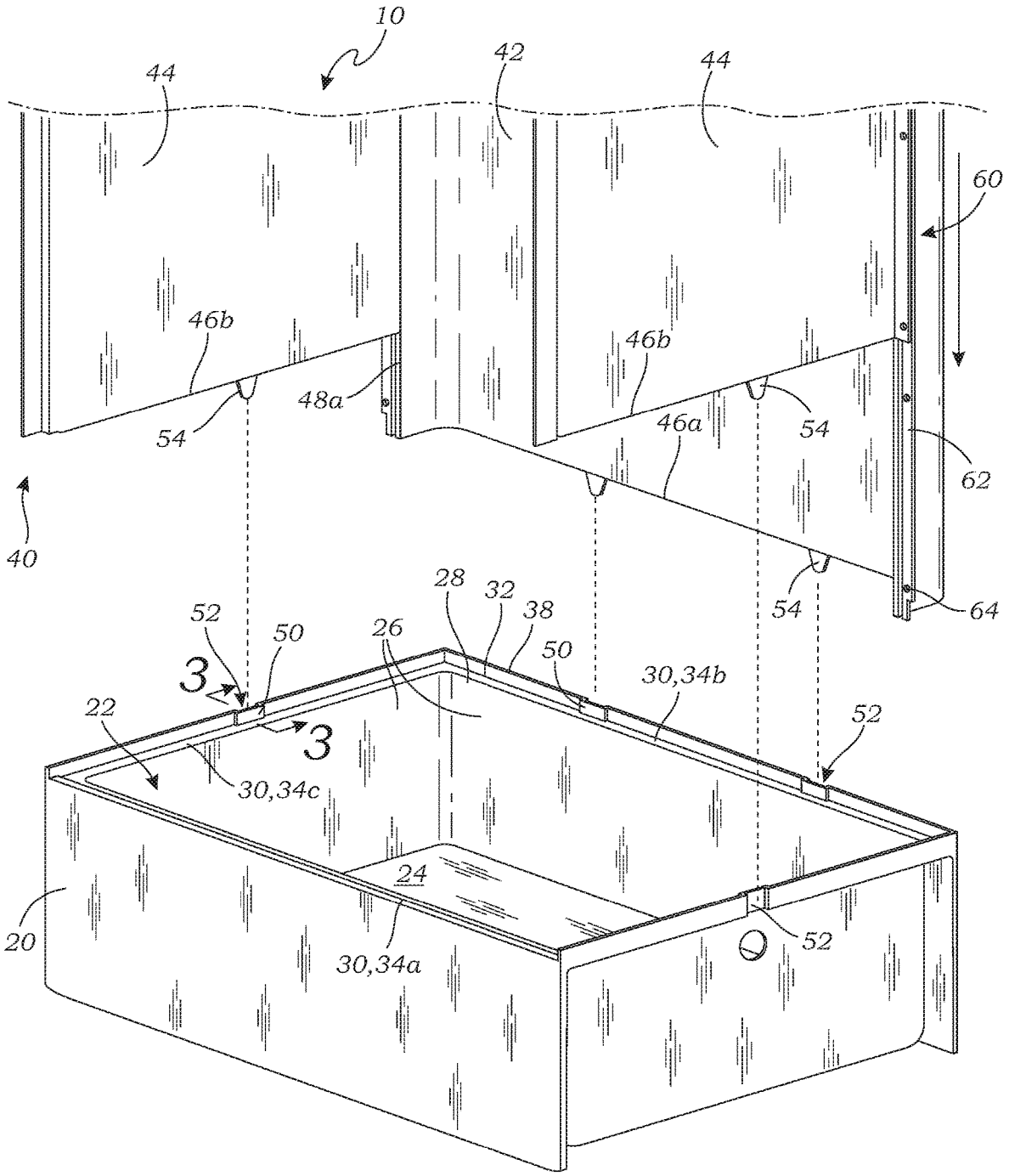
FIG. 2 is an exploded perspective view thereof.

FIG. 2 is an exploded perspective view of the bathing area surround 10. As shown in FIG. 2, the bathtub 20 includes a bathing basin 22 formed by a bottom surface 24 surrounded by an upwardly extending sidewall 26 which extends upwardly to a rim 28. The bathtub 20 further includes a tub ledge 30 extending outwardly from the rim 28, traverse to the sidewall 26, to an edge 32. The tub ledge 30 is formed by a front portion 34*a* and a rear portion 34*b* connected by side portions 34*c*.

A tub flange 38 extends upwardly from or adjacent the edge 32, to help prevent leakage. In this embodiment, the tub flange 38 extends upwardly from the rear portion 34*b* and the side portions 36 of the tub ledge 30 adjacent the edge 32. The tub flange 38 is shaped to form at least one inwardly extending pocket 50 in the rear portion 34*b*, and each of the side portions 36, which forms a tab receiving recess 52. In this embodiment, the rear portion 34*b* includes two tab receiving recesses 52, but in other embodiments, there may be a different number of recesses 52, as deemed suitable by the manufacturer.

As shown in FIG. 2, the tub surround 40 includes multiple panels for surrounding three sides of the bathing area. The back panel 42 has a bottom edge 46*a* and side edges 48*a*, and each of the side panels 44 has a bottom edge 46*b*, and two side edges 48*b*. The back panel 42 and the two side panels 44 each have downwardly extending locking tabs 54 formed in their bottom edges 46*a* and 46*b*, shaped to be inserted into the corresponding tab receiving recess 52, which is importantly located behind the tub flange 38 (opposite the rim 28 of the bathing basin 22).

In this embodiment, the locking tabs 54 are constructed of polymer plastic and are integral with the rest of the tub surround 40, but in other embodiments, the locking tabs 54 may be any material which is rigid and resilient for secure insertion into the tab receiving recesses 52 (e.g., glass fiber, metal, etc.). In this embodiment, the locking tabs 54 are tapered to facilitate installation, but in other embodiments the locking tabs 54 may be any shape that may fit in the recesses 52, e.g., round, rectangular, triangular, etc. In the present invention, the locking tabs 54 are positioned behind the tub flange 38, and do not extend downwardly into the tub ledge 30.

Figure 3:
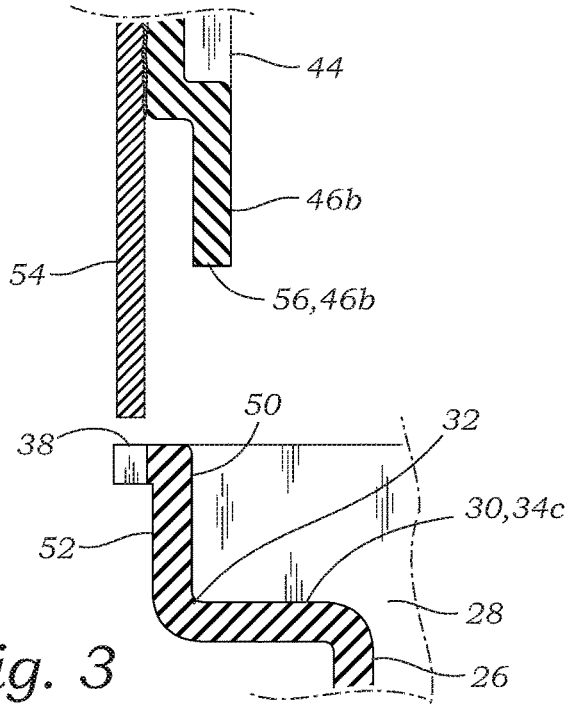
FIG. 3 is a sectional view thereof taken along line 3-3 in FIG. 2.
Figure 4:
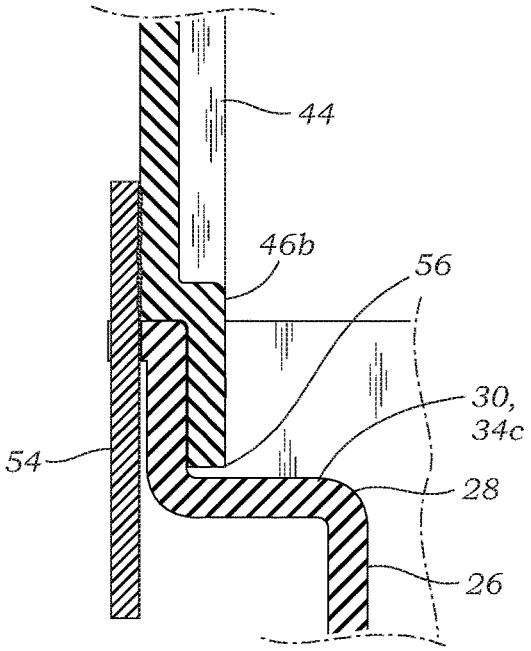
FIG. 4 is a sectional view thereof taken along line 4-4 in FIG. 1.

FIG. 3 is a sectional view of the bathing area surround 10 taken along line 3-3 in FIG. 2, and FIG. 4 is a sectional view thereof taken along line 4-4 in FIG. 1. FIGS. 2-4 illustrate one embodiment of how the locking tabs 54 interlock with the recesses 52. In this embodiment, the bottom edge 46*b* of the side panel 44 may further include a front sealing edge 56 that abuts the rear portion 34*c* of the tub ledge 30 between the tub flange 38 and the rim 28 of the bathtub 20. With this configuration, the tabs 54 are able to facilitate proper installation, and by interlocking behind the flange 38, leaks are prevented.

Figure 5:
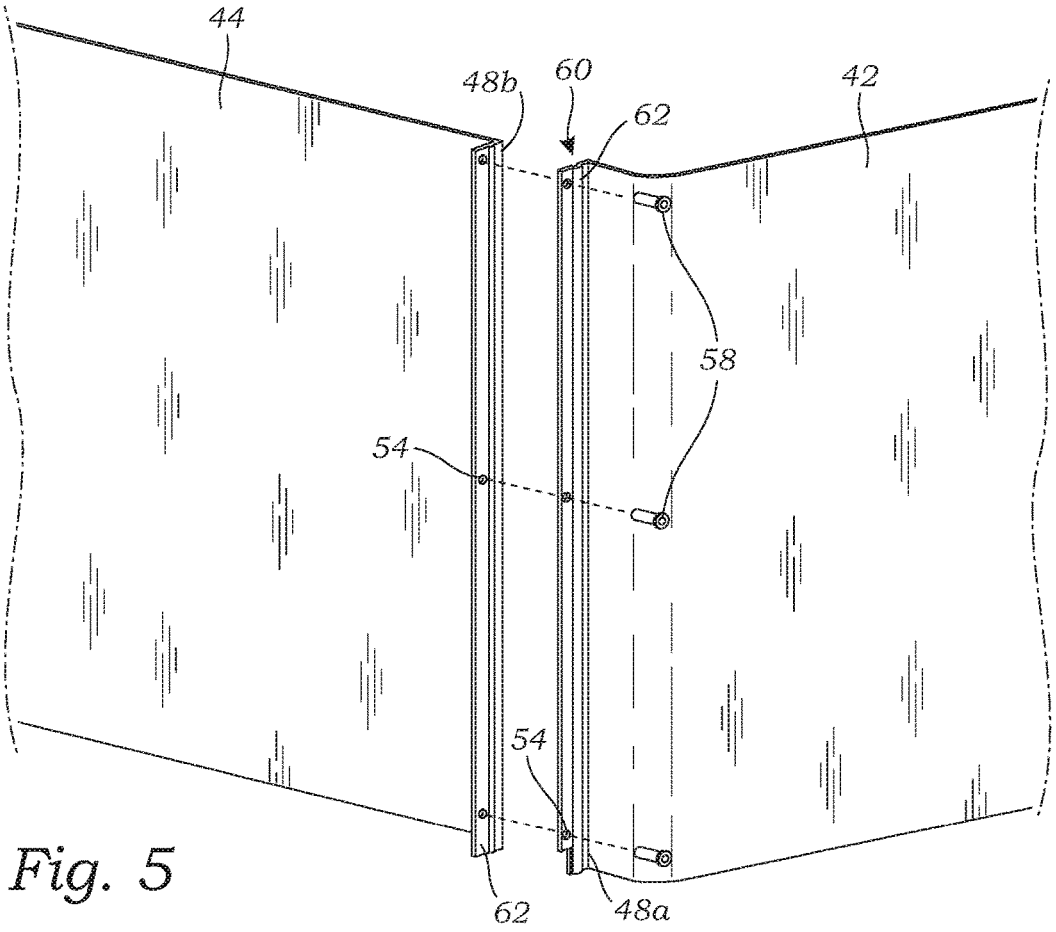
FIG. 5 is a rear perspective view, illustrating fasteners for fastening a water-tight seam between two panels of the surround.

FIG. 5 is a rear perspective view of the bathing area surround 10, showing fasteners 58 for fastening a water-tight seam 60. Once the downwardly extending tabs 54 have been inserted into the receiving recesses 52, at least one of the side edges 48*a* of the back panel 42 abuts one of the side edges 48*b* of at least one of the side panels 44 to form the water-tight seam 60. In this embodiment, each side edge 48*a* of the back panel abuts one of the side edges 48*b* of each of the side panels 44. As shown in FIGS. 2 and 5, each of the abutting side edges 48 may include a panel flange 62 having a plurality of holes 54 for receiving the fasteners 58, wherein the fasteners 58 fasten the back panel 42 to each of the two side panels 44. In some embodiments, the fasteners 58 are in the form of push lock rivets positioned adjacent the water-tight seam 60 for securing the side edges 48 together. However, in other embodiments, the fasteners 58 may be in the form of clips, locks, ties, a powerful adhesive, etc., or any other type of fastener known to those in the art. In this embodiment, the panel flanges 62 extend outwardly from the bathtub 20, and are not visible in the fully constructed configuration of FIG. 1.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A bathing area surround, comprising:

a bathtub;

a tub surround comprising a back panel, and two side panels, each of the back panel and the two side panels having a bottom edge and two side edges;

the bathtub having a bathing basin formed by a bottom surface surrounded by an upwardly extending sidewall which extends upwardly to a rim;

the bathtub further comprising a tub ledge extending outwardly from the rim, traverse to the sidewall, to an edge;

wherein the tub ledge is formed by a front portion and a rear portion connected by side portions;

a tub flange which extends upwardly from the rear portion and the side portions of the tub ledge adjacent the edge;

wherein the tub flange is shaped to form at least one inwardly extending pocket in the rear portion, and each of the side portions, which forms a tab receiving recess;

wherein the back panel and the two side panels each have downwardly extending locking tabs formed in their bottom edges, shaped to be inserted into the corresponding tab receiving recess, behind the tub flange; and fasteners for fastening the back panel to each of the two side panels.

2. The bathing area surround of claim 1, wherein the fasteners are push lock rivets.

3. The bathing area surround of claim 2, wherein at least one of the side edges of the back panel abuts one of the side edges of at least one of the side panels to form a water tight seam of the tub surround, and the push lock rivets are positioned adjacent the water tight seam for securing the two side edges together.

4. The bathing area surround of claim 1, wherein the bottom edge of the rear panel further includes a front sealing edge that abuts the rear portion of the tub ledge between the tub flange and the rim of the bathtub.

5. The bathing area surround of claim 1, wherein the bottom edge of each of the side panels further includes a front sealing edge that abuts the side portion of the tub ledge between the tub flange and the rim of the bathtub.

6. The bathing area surround of claim 1, wherein at least one of the side edges of the back panel and at least one of the side edges of one of the side panels each includes a panel flange, which abut in an installed position.

7. The bathing area surround of claim 6, wherein the panel flange includes a plurality of holes for receiving the fasteners.

* * * * *